US007331068B1

(12) United States Patent
Tichenor

(10) Patent No.: US 7,331,068 B1
(45) Date of Patent: Feb. 19, 2008

(54) WATER CONSERVING URINAL

(76) Inventor: Clyde LeRoy Tichenor, P.O. Box 734, Somis, CA (US) 93066

( * ) Notice: Subject to any disclaimer, the term of this patent is extended or adjusted under 35 U.S.C. 154(b) by 0 days.

(21) Appl. No.: 11/524,156

(22) Filed: Sep. 19, 2006

Related U.S. Application Data

(60) Provisional application No. 60/719,537, filed on Sep. 21, 2005.

(51) Int. Cl.
*E03D 13/00* (2006.01)

(52) U.S. Cl. ..... 4/310; 4/301

(58) Field of Classification Search ..... 4/301–305, 4/310, 311
See application file for complete search history.

(56) References Cited

U.S. PATENT DOCUMENTS 266,200 A * 10/1882 Day ..... 5/202
3,964,110 A * 6/1976 Kapit ..... 4/311
4,137,579 A * 2/1979 Soler ..... 4/311
5,737,779 A * 4/1998 Haddock ..... 4/301
2002/0157176 A1* 10/2002 Wawrla et al. ..... 4/304

* cited by examiner

*Primary Examiner*—Huyen Le

(57) ABSTRACT

A wall mountable urinal having an ultra-low use of flush water, minimum material and a self-cleaning action. The urinal comprises an upright bowl that uses a flushing action provided by a misting water jet that is centered above the bowl and that provides a fine mist of water. The water mist washes the entire bowl up to its upper edge and the water droplets that accumulate upon the bowl are guided into a drain. An electrical detector that detects the user's presence is provided that is capable of initiating the flushing water mist during use and for a predetermined time thereafter.

3 Claims, 2 Drawing Sheets

WATER CONSERVING URINAL

This application claims priority of Provisional Application No. 60/719,537, filed Sep. 21, 2005.

TECHNICAL FIELD

The invention generally pertains to plumbing fixtures and more particularly to a urinal that has a vertically adjustable mounting position and provides ultra-low water usage as well as a self-cleaning feature.

BACKGROUND ART

Existing male urinal fixtures typically use a gallon or more of water to flush. The urinal fixtures have large ceramic areas that are not flushed and provide a source for lingering urine odor. Because urinals become unclean, they usually contain scent cakes to mask this urine odor. Flushing is either manual or automatic after each use. Urinals require fixed large diameter drain and flush plumbing, periodic daily cleaning for sanitary use, and a fixed low mounting for children's use.

DISCLOSURE OF THE INVENTION

The present invention consists basically of a urinal comprising an upright bowl that uses a flushing principle provided by a misting water jet centered above the bowl that provides a fine mist of water that continuously wets the entire bowl in a random fashion. It therefore washes the entire bowl as fine water droplets accumulate upon the bowl and then run down into a drain. The misting water jet is active during the use of the bowl and for a period of time thereafter. The misting water jet which is a standard horticulture type used in orchid nurseries, has a fine filter screen attached by threads to the end opposite the misting water jet nozzle. The misting water jet is supported at a distance above and over the center of the urinal bowl so that it allows the water to spread out and also reach the top of the bowl. The distance normally is approximately equal to, or slightly greater than, the bowl's radius. A cylindrical adjustable splash guard, which is placed around the misting water jet, prevents occasional larger spray droplets from falling outside the bowl's edge onto a user.

In typical use, this invention has required only 10 ounces or less of water for each use. This is 1/12th of the water standard urinals use. Also many months of testing, purposely without cleaning, have resulted in no detectable odors. The small plumbing meter requirements of this invention provide easy installation, minimum material, and lower costs. The small water flow in the drain and flush plumbing can allow flexible connection means and an adjustable vertical positioning of the urinal. It also has the advantage of being very quiet in use.

Modern urinals and other plumbing fixtures have automatic person-use-detectors that activate the water flush valves. The instant invention is best used with an automatic detector, such as a floor switch, optical beam, body heat or ultra-sonic type detector. Since the urinal may operate up to four minutes after a person has left, a suitable 'after-use' flush time must be added to the plumbing or sensing circuitry that activates a solenoid water valve controlling the misting water jet.

Optionally, a vertical standpipe of sufficient volume may be added to the flush plumbing between the solenoid and the urinal jet. The standpipe will provide a compressed air trap that will force any remaining standpipe water to continue to flow and mist into the urinal for 4 or 5 additional minutes depending on the standpipe volume. In portable service, sufficient water and pressure for the mist jet sprayer may be optionally supplied by a pump and pressure tank.

Further, use during any flush cycle will simply cause continuous flushing until several minutes elapse after the last user. In spite of this, tests show that this total usage of water is less than 10 ounces of water in an 80-psi system. The $1/12^{th}$ of the current type of fixture water use saves 11 gallons of water for 12 uses! The inner washed thin upper bowl edge minimizes urine collection and odor.

A BRIEF DESCRIPTION OF THE DRAWINGS

BEST MODE FOR CARRYING OUT THE INVENTION

The Best Mode For Carrying Out The Invention is presented in terms of a preferred embodiment.

Figure 1:
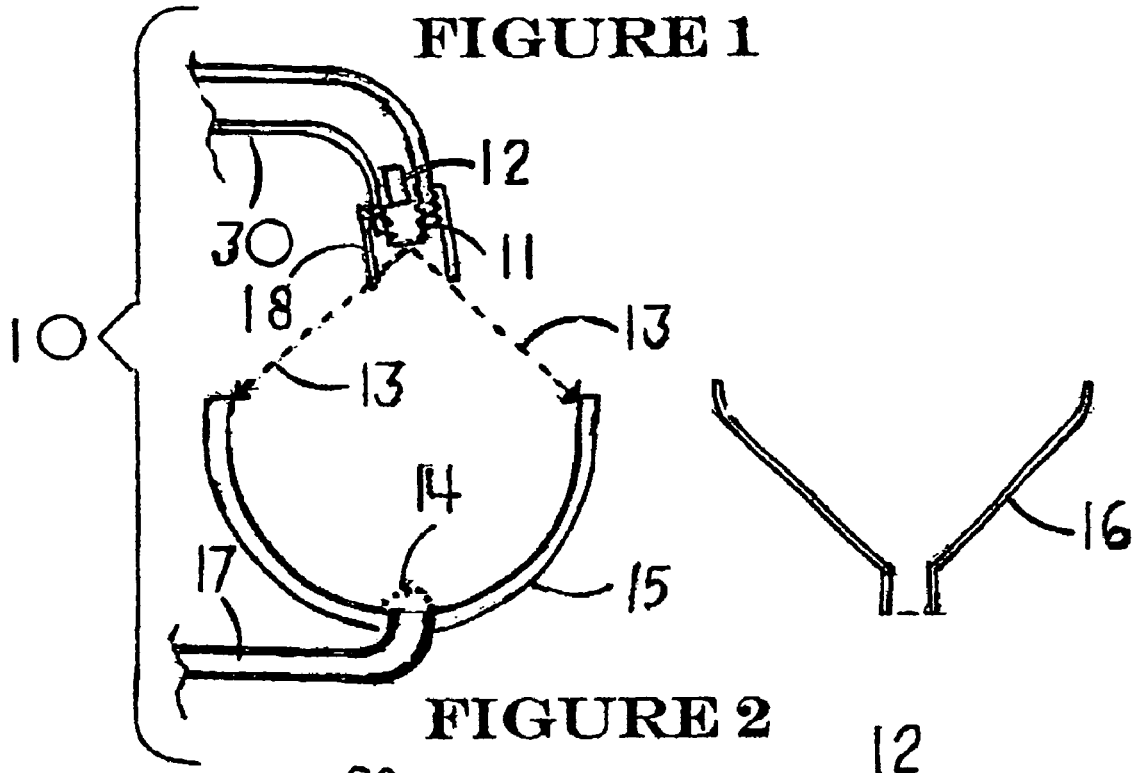
FIG. 1 is a simplified sectional diagram of the urinal comprising a misting water jet, the bowl, two versions showing a hemispherical type bowl A and a conical type bowl B, and the drain showing the basic physical relationships of the urinal.
Figure 4:
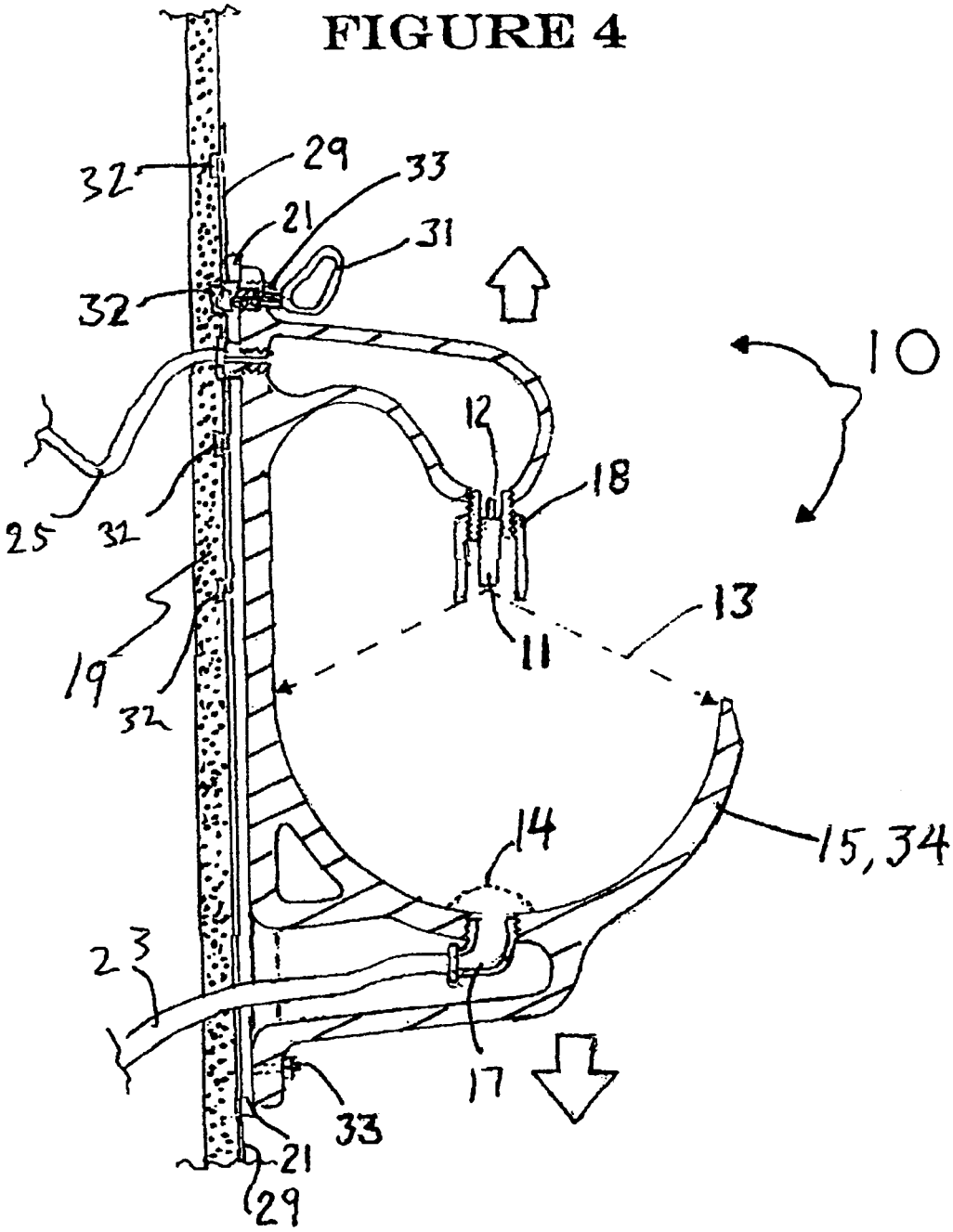
FIG. 4 is a sectional diagram of the misting water jet urinal as might be configured in a wall mounted porcelain fixture depicting the various component relationships of the urinal and a vertical slide mounting with flexible hose connections is shown (also in section).

The present urinal invention 10 is comprised of a wall mounted, upright hemispherical bowl 15 or conical upright bowl 16 that uses a new flushing action provided by a substantially centrally located misting water jet 11 having a fine water mist 13 that is activated by a solenoid valve 20 attached to a main water line 28 and controlled by a sensor 22, that continually wets the entire interior surface of the upright hemispherical bowl 15 in a random fashion and therefore washes the entire upright hemispherical bowl 15. The fine water mist 13 that settle upon the upright hemispherical bowl 15 may be seen in FIGS. 1 and 4 that depict the misting water jet 11 with a removable jet filter 12, the upright hemispherical bowl 15 and conical bowl 16 (2 bowl versions) attached to a drain connection 17. As shown in FIGS. 1 &4, a controlled water line 30 is connected to the misting water jet 11, and is further connected via a solenoid valve 20 to the main water line 28. An adjustable cylindrical shield 18 precisely controls the upper edge of the fine water mist 13. The water mist falls upon the entire upper surface of the upright bowl 15 or 16 as shown in FIG. 1. All liquids from the bowl pass through a screen 14 and fall into the drain connection 17 for disposal. FIG. 4 also shows the urinal configured in section as a ceramic fixture 34 depicting the various component relationships and how the urinal is attached to a wall 19 as a vertically positional slide mounting 21. The mounting adjustability requires that both the controlled waterline 30 be a flexible controlled water line 25 and that the drain connection 17 also is flexible connection 23. The ceramic fixture 34 urinal is attached by a plurality of mounting bolts 33 to the vertically positional mounting 21 which is supported on slides vertically for adjustment in a 'V' groove slide support 29 that is attached to the wall 19. The vertical locking holes 32 support a spring-loaded locking pin with handle 31 and therefore the urinal 10.

Figure 2:
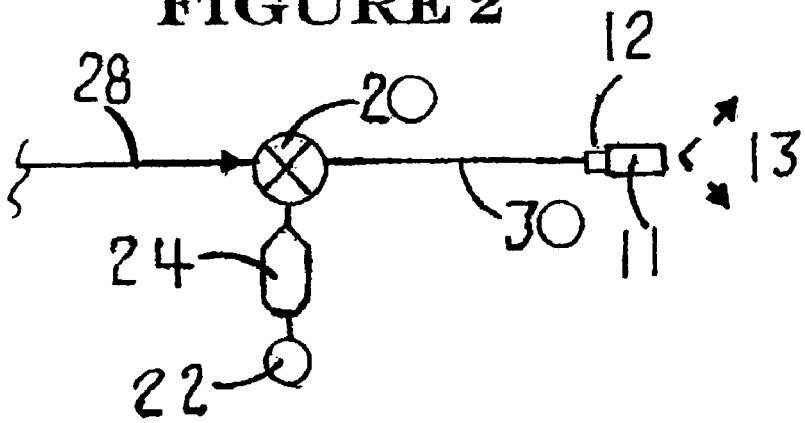
FIG. 2 is a drawing of the main water line to the misting water jet with the solenoid valve and the delay type sensor circuits that control the valve to the urinal.

As shown in FIG. 2, the main water line 28 is connected to the misting water jet 11 with the solenoid valve 20 that operates the controlled waterline 30. An electronic delay type sensor circuit 24 and sensor 22 control the solenoid valve 20. The sensor 22 may be in the form of a floor switch, an optical beam, an infrared sensor, or ultra-sonic sensor.

Figure 3:
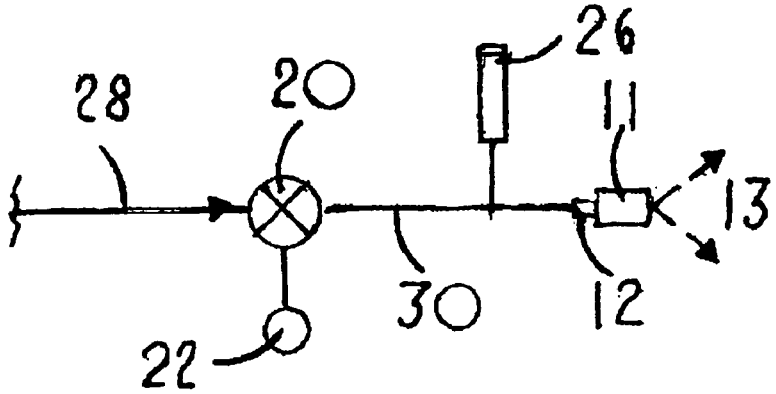
FIG. 3 is a drawing of the main water line to the misting water jet with the solenoid valve and a vertical standpipe to supply a delaying action to the water jet spray.

As shown in FIG. 3, the main water line 28 to the misting water jet 11 with the solenoid valve 20 that controls the waterline 30 connected to a closed upper end vertical standpipe 26 with selected water and air volumes to supply a delaying action to the terminating misting water jet 11. The controlling sensor 22 without additional delay circuitry may be the same as any specified in FIG. 2.

While the invention has been described in detail and pictorially shown in the accompanying drawings, it is not to be limited to such detail, since many changes and modifications may be made in the invention without departing from the spirit and scope thereof.

The invention claimed is:

1. A wall mountable urinal comprising:

a) an upright bowl having a bottom drain, b) a misting water jet connected to a water supply and that is positioned centrally above said bowl, wherein said jet is designed to spray misting water onto said bowl's entire upright surface during and after use, c) an electric solenoid valve that controls the water flow into said misting water jet, d) an electric sensor that detects a user's presence when the user is adjacent said urinal, at which time said sensor produces an electrical signal that activates said electric solenoid valve, and e) a capped vertical standpipe that is connected between the electric solenoid valve and the input to said misting water jet, wherein said standpipe provides a selected amount of water backed by trapped pressure in the upper volume of the standpipe that provides a decreasing flow of rinsing water to terminate the water flow after the urinal is used.

2. The wall mountable urinal as specified in claim 1 wherein said misting water jet is comprised of a standard commercial mist spray jet that incorporates a filter.

3. The wall mountable urinal as specified in claim 1 wherein said upright bowl has a hemispherical shape having an inner surface, an outer surface, an upper edge and wherein the bottom drain is attached to the lowest portion of said bowl.

* * * * *